US007381369B2

(12) United States Patent
Ishida et al.

(10) Patent No.: US 7,381,369 B2
(45) **Date of Patent: *Jun. 3, 2008**

(54) FREE CUTTING ALLOY

(75) Inventors: Kiyohito Ishida, 5-20, Kamisugi 3-chome, Aoba-ku, Sendai-shi, Miyagi 980-0011 (JP); Katsunari Oikawa, 4-1-34, Nishifunabasama, Shibata-cho, Shibata-gun, Miyagi 989-1622 (JP); Takashi Ebata, Miyagi (JP); Tetsuya Shimizu, Nagoya (JP); Michio Okabe, Chita (JP)

(73) Assignees: Kiyohito Ishida, Sendai (JP); Katsunari Oikawa, Miyagi (JP); Daido Tokushuko Kabushiki Kaisha, Nagoya (JP); Tohoku Tokushuko Kabushiki Kaisha, Miyagi (JP); Japan Industrial Technology Association, Tokyo (JP); Tohoku Technoarch Co., Ltd., Sendai (JP)

( * ) Notice: Subject to any disclaimer, the term of this patent is extended or adjusted under 35 U.S.C. 154(b) by 359 days.

This patent is subject to a terminal disclaimer.

(21) Appl. No.: 10/847,403

(22) Filed: May 18, 2004

(65) Prior Publication Data

US 2005/0000602 A1 Jan. 6, 2005

Related U.S. Application Data

(63) Continuation-in-part of application No. 10/242,768, filed on Sep. 13, 2002, now abandoned, which is a continuation-in-part of application No. 09/653,344, filed on Aug. 31, 2000, now abandoned.

(30) Foreign Application Priority Data

Sep. 3, 1999 (JP) ..... 11-250902
Mar. 14, 2000 (JP) ..... 2000-070257
Jul. 21, 2000 (JP) ..... 2000-221433
Aug. 22, 2000 (JP) ..... 2000-251602
Aug. 22, 2000 (JP) ..... 2000-251626

(51) Int. Cl.

| | |
|---|---|
| ***C22C 30/00*** | (2006.01) |
| ***C22C 19/05*** | (2006.01) |
| ***C22C 27/06*** | (2006.01) |
| ***C22C 16/00*** | (2006.01) |
| ***C22C 38/60*** | (2006.01) |
| ***C22C 38/40*** | (2006.01) |

(52) U.S. Cl. ..... 420/584; 420/451; 420/452; 420/428; 420/423; 420/41; 420/42; 420/43; 420/56; 148/333; 148/336; 148/419; 148/423; 148/427; 148/442; 148/127

(58) Field of Classification Search ..... None
See application file for complete search history.

(56) References Cited

U.S. PATENT DOCUMENTS

| | | | |
|---|---|---|---|
| 3,645,722 | A | 2/1972 | Aulenbach et al. |
| 4,705,581 | A | 11/1987 | Honkura et al. |
| 4,969,963 | A | 11/1990 | Honkura et al. |
| 6,033,625 | A | 3/2000 | Nagashima et al. |

FOREIGN PATENT DOCUMENTS

| | | |
|---|---|---|
| EP | 0767 247 A1 | 4/1997 |
| EP | 0 903 418 A1 | 3/1999 |
| JP | 33-7060 | 8/1958 |
| JP | 49-33243 | 9/1974 |
| JP | 54-17567 | 6/1979 |
| JP | 56-16653 | 2/1981 |
| JP | 60-155653 | 8/1985 |
| JP | 62-267455 | 11/1987 |
| JP | 63-65055 | 3/1988 |
| JP | 63-86848 | 4/1988 |
| JP | 63-093843 | 4/1988 |
| JP | 64-8258 | 1/1989 |
| JP | 2-163348 | 6/1990 |
| JP | 2-170948 | 7/1990 |
| JP | 2-179855 | 7/1990 |
| JP | 2-258955 | 10/1990 |
| JP | 2805808 | 10/1990 |
| JP | 3-44448 | 2/1991 |
| JP | 3-173749 | 7/1991 |

structure of stainless steel deposited metals

| | | |
|---|---|---|
| JP | 3-180449 | 8/1991 |
| JP | 4-318153 | 11/1992 |
| JP | 5-117792 | 5/1993 |
| JP | 5-171364 | 7/1993 |
| JP | 6-10102 | 1/1994 |
| JP | 6-200355 | 7/1994 |
| JP | 7-233449 | 9/1995 |
| JP | 7-233452 | 9/1995 |
| JP | 2521479 | 5/1996 |
| JP | 9-49053 | 2/1997 |
| JP | 10-8219 | 1/1998 |
| JP | 10-046292 | 2/1998 |
| JP | 2742578 | 2/1998 |
| JP | 10-130794 | 5/1998 |
| JP | 10-140289 | 5/1998 |
| JP | 10-195605 | 7/1998 |
| JP | 10-237603 | 9/1998 |
| JP | 11-1743 | 1/1999 |
| JP | 11-229032 | 8/1999 |
| JP | 11-229082 | 8/1999 |
| JP | 11-279717 | 10/1999 |
| JP | 11-293390 | 10/1999 |
| JP | 11-323487 | 11/1999 |
| JP | 11-140597 | 3/2000 |
| JP | 2000-192202 | 7/2000 |
| JP | 3197573 | 6/2001 |
| SE | 1 519 313 | 7/1978 |

OTHER PUBLICATIONS

Kaneko, Hideo et al., "Sulfide forming Tendency of Alloying Elements in Steel," *Journal of the Japan Institute of Metals,* 1963, pp. 299-304, vol. 27.

Narita, Kiichi et al., "Carbo-Nitrogen Sulphide in Steel Containing Titanium," *Tetsu-to-Hagane* (*Transactions of the Iron and Steel Institute of Japan*), 1972, pp. 140-142, vol. 9.

Kiessling, Roland, "Sulfide Inclusions: A Summary and Study of Sulfides in Resulfurized Ferritic Eli-Steels of the 18:2 Type," *Metal Working Technol.,* 1975, pp. 104-122, Ser. No. 6.

Kiessling, Roland, "Influence of Sulfide Composition on the Machinability and Corrosion Properties of a Resulfurized Ferritic 18:2 Steel," *International Symposium on Influence of Metallurgy on Machinability of Steel,* Sep. 26-28, 1977, pp. 253-261.

Kaneko, Hideo et al, *Magnetic Material,* The Japan Institute of Metals, Nov. 20, 1977, pp. 142-149.

Kiessling, R. et al., "Non-metallic inclusions in steel," 1978, pp. 137-139, 144-145, and 157-159, London, GB: The Institute of Materials, XP002155733.

Japanese Institute of Metals, ed., *Revised Third Version Kinzoku* (*Metal*) *Data Book,* Maruzen, p. 223 Jun. 30, 1995, 3rd Version.

Tsuge, Shinji et al., "Effects of S Addition on the Formability and Corrosion Resistance of SHU409L Stainless Steel," *Sumitomo Kinzoku,* 1997, pp. 65-72, vol. 49, No. 4.

Nakama, Kazuo et al., "Effect of Mn/S ratio on Properties of Free Machining Ferritic Stainless Steels," *Sanyo Technical Report,* 1997, pp. 55-59, Vol. 4, No. 1.

Japanese Industrial Standards, G 4304, "Hot Rolled Stainless Steel Plates, Sheets and Strip," 1999, pp. 670-684.

Japanese Industrial Standards, B0601, "Surface Roughness—Definitions and Designation," 1994, pp. 15-26.

Japanese Industrial Standards, G4311, "Heat-Resisting Steel Bars," 1991, pp. 712-717.

Japanese Industrial Standards, G4312, "Heat-Resisting Steel Plates and Sheets," 1991, pp. 720-728.

*Primary Examiner*—John P. Sheehan
(74) *Attorney, Agent, or Firm*—Oliff & Berridge, PLC

(57) ABSTRACT

Provided is free cutting alloy excellent in machinability, preserving various characteristics as alloy. The free cutting alloy contains: one or more of Ti and Zr as a metal element component; and C being an indispensable element as a bonding component with the metal element component, wherein a (Ti,Zr) based compound including one or more of S, Se and Te is formed in a matrix metal phase. The free cutting alloy is more excellent in machinability, preserving various characteristics as alloy at similar levels to a conventional case. The effect is especially conspicuous, for example, when a compound expressed in a chemical form of $(Ti,Zr)_4C_2(S,Se,Te)_2$ as the (Ti,Zr) based compound is formed at least in a dispersed state in the alloy structure.

17 Claims, 4 Drawing Sheets structure of stainless steel deposited metals

FREE CUTTING ALLOY

RELATED APPLICATIONS

This application claims the priority of Japanese Patent Application Nos. 11-250902 filed on Sep. 3, 1999, 2000-070257 filed on Mar. 14, 2000, 2000-221433 filed on Jul. 21, 2000, 2000-251602 filed on Aug. 22, 2000, and 2000-251626 filed on Aug. 22, 2000, which are incorporated herein by reference. This application is a continuation-in-part application of U.S. patent application Ser. No. 10/242,768, filed Sep. 13, 2002 (now abandoned), which is a continuation-in-part application of U.S. patent application Ser. No. 09/653,344, filed Aug. 31, 2000, now abandoned.

BACKGROUND ART

The present invention relates to free cutting alloy excellent in machinability.

Alloy has widespread applications because of a variety of characteristics thereof. A free cutting alloy excellent in machinability is, in a case, selected for improvement of productivity. In order to improve machinability, for example, free cutting alloy containing an element improving machinability such as S, Pb, Se or Bi (hereinafter referred to as machinability-improving element) is widely used. Especially in a case where machinability is particularly required because of precise finishing in machining or for other reasons, not only is a content of such a machinability-improving element increased in an alloy, but the elements are also added to an alloy in combination.

While S, which has widely been used for improvement of machinability, is in many cases added in the form of MnS, addition thereof in an alloy in a large content is causes for degrading corrosion resistivity, hot workability and cold workability of the alloy. Moreover, when the alloy is exposed to the air, a sulfur component included in the alloy is released into the air in the form of a sulfur containing gas, which causes sulfur contamination in peripheral areas of parts with ease. Therefore, there arises a necessity of suppressing release of sulfur containing gas (hereinafter referred to as improvement on out-gas resistivity). Elements such as S. Se and Te, however, deteriorate magnetic properties to a great extent in an electromagnetic stainless steel and the like.

Therefore, various proposals have been made: a Mn content is limited, a Cr content in sulfide is increased or in a case where S is contained, Ti is added in combination with S in order to disperse sulfide in the shape of a sphere (for example, see JP-A-98-46292 or JP-A-81-16653). To increase a Cr content in sulfide, however, tends to greatly decrease in machinability and hot workability and therefore, such an alloy has been restricted on its application in many cases.

Although such prior arts as JP11-140597 ('597), JP10-130794 ('794), JP2-170948 ('948), JP63-93843 ('843), JP60-155653 ('653) and U.S. Pat. No. 4,969,963 (Honkura et al.) disclose various free cutting alloys, these alloys are not satisfactory in machinability, sulfur out-gassing characteristics and elimination of Pb content.

It is accordingly an object of the present invention is to provide free cutting alloy excellent in machinability, showing outstanding characteristics as an alloy such as corrosion resistivity, hot workability and cold workability or specific magnetic characteristics, which are comparable to those of conventional alloys.

SUMMARY OF THE INVENTION

In order to achieve the above described object, a free cutting alloy of the present invention is characterized by that the free cutting alloy contains: one or more of Ti and Zr as a metal element component; and C being an indispensable element as a bonding component with the metal element component, wherein a (Ti,Zr) based compound including one or more of S, Se and Te is formed in a matrix metal phase.

Machinability of an alloy can be improved by forming the above described (Ti, Zr) based compound in a matrix metal phase of the alloy. Furthermore, by forming this compound in the alloy, formation of compounds such as MnS and (Mn,Cr)S, easy to reduce corrosion resistivity and hot workability of the alloy, can be prevented or suppressed, thereby enabling corrosion resistivity, hot workability and cold workability to be retained at good levels. That is, according to the present invention, a free cutting alloy excellent in machinability can be realized without any degradation in useful characteristics as an alloy such as hardness, corrosion resistivity, hot workability, cold workability and specific magnetic characteristics.

Further, a (Ti,Zr) based compound formed in a free cutting alloy of the present invention can be dispersed in the alloy structure. Especially dispersing the compound in an alloy structure can further increase machinability of an alloy. In order to increase the effect, a particle size of the (Ti,Zr) based compound as observed in the structure of a polished section of the alloy is preferably, for example, approximately in the range of 0.1 to 30 μm on the average and further, an area ratio of the compound in the structure is preferably in the range of 1 to 20%, wherein the particle size is defined by the maximum distance between two parallel lines circumscribing a particle in observation when parallel lines are drawn intersecting on a region including the particle in observation while changing a direction of the parallel lines.

The above described (Ti,Zr) based alloy can include at least a compound expressed in a composition formula $(Ti,Zr)_4(S,Se,Te)_2C_2$ (hereinafter also referred to as carbosulfide/selenide), wherein one or more of Ti and Zr may be included in the compound and one or more of S, Se and Te may be included in the compound. By forming a compound in the form of the above described composition formula, not only can machinability of an alloy be improved, but corrosion resistivity is also improved.

It should be appreciated that identification of a (Ti,Zr) based compound in an alloy can be performed by X-ray diffraction (for example, a diffractometer method), an electron probe microanalysis method (EPMA) and the like technique. For example, the presence or absence of the compound of $(Ti,Zr)_4(S,Se,Te)_2C_2$ can be confirmed according to whether or not a peak corresponding to the compound appear in a diffraction chart measured by an X-ray diffractometer. Further, a region in the alloy structure in which the compound is formed can also be specified by comparison between two-dimensional mapping results on characteristic X-ray intensities of Ti, Zr, S, Se or C obtained from a surface analysis by EPMA conducted on a section structure of the alloy.

PREFERRED EMBODIMENTS OF THE INVENTION

Figure 1:
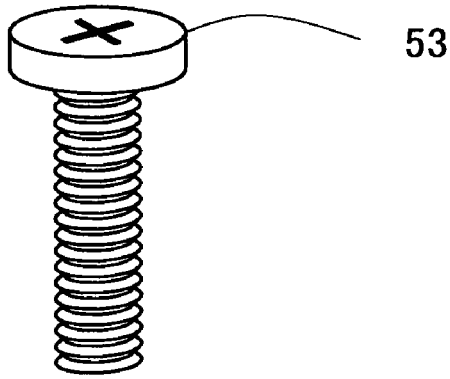
FIG. 1 shows a screw as an example of a metal component.

The metal component of the present invention is composed of a free cutting alloy, and has at least apart of the surface thereof subjected to cutting, wherein the free cutting alloy is constituted as austenite iron containing alloy containing:

2 to 50 mass % Ni; 12 to 50 mass % Cr; 5 to 85.926 mass % Fe; 0.021 to 0.4 mass % C.

one or more of Ti and Zr such that $W_{Ti}+0.52\ W_{Zr}=0.03$ to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that the total amount of S and Se is more than the C content;

and wherein a total content in mass % of Ti and Zr is 1.55 or more times as much as a total content in mass % of S and Se;

and wherein a (Ti,Zr) based compound containing one or more of Ti and Zr as a metal element component, C being an indispensable element as a bonding component with the metal element component, and one or more of S, Se and Te is dispersed in a matrix metal phase.

A method of fabricating a metal component of the present invention comprises a step of subjecting a free cutting alloy to cutting to thereby obtain a metal component having a desired geometry, wherein the free cutting alloy is constituted as austenite iron containing alloy containing:

2 to 50 mass % Ni; 12 to 50 mass % Cr; 5 to 85.926 mass % Fe; 0.021 to 0.4 mass % C.

one or more of Ti and Zr such that $W_{Ti}+0.52\ W_{Zr}=0.03$ to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that the total amount of S and Se is more than the C content;

and wherein a total content in mass % of Ti and Zr is 1.55 or more times as much as a total content in mass % of S and Se;

and wherein a (Ti,Zr) based compound containing one or more of Ti and Zr as a metal element component, C being an indispensable element as a bonding component with the metal element component, and one or more of S, Se and Te is dispersed in a matrix metal phase.

Because the free cutting alloy has an excellent corrosion resistance, workability and machinability, the present invention is successful in obtaining a non-magnetic metal component excellent in corrosion resistance through cutting and making it into a desired geometry.

Herein, austenite containing stainless steel means stainless steel containing not only Fe as a main component, but an austenitic phase in the structure. While there are below exemplified corresponding kinds of steel exhibited in JIS G 4304, neither of elements Ti, Zr, S and Se as essential features of the present invention is naturally expressed in compositions described in the standard. In this case, part of Fe content of each of the above described kinds of stainless steel is replaced with the above described elements in the respective above described compositional ranges and thereby martensite containing stainless steel of the present invention is obtained. Therefore, while in description of the present specification, the same JIS Nos. are used, those actually means alloys specific to the present invention, which alloys have compositions defined in JIS standards as a base only.

(1) Austenitic stainless steel is stainless steel showing an austenitic structure even in room temperature and can be exemplified as follows: SUS 201, SUS 202, SUS 301, SUS 301J, SUS 302, SUS 302B, SUS 304, SUS 304N1, SUS 304N2, SUS 305, SUS 309S, SUS 310S, SUS 316, SUS 316N, SUD 316J1, SUS 317, SUS 317J1, SUS 321, SUS 347, SUS XM15J1, SUS 836L, SUS 890L and so on.

(2) Austenitic-ferritic stainless steel is stainless steel showing a dual phase structure of austenite and ferrite and can be exemplified SUS 329J4L and so on.

(3) Precipitation hardening stainless steel is a stainless steel obtained by adding elements such as aluminum and copper, and precipitating a compound with the elements as main components by a heat treatment to harden and can be exemplified SUS 630, SUS 631 and so on. It should be appreciated that a concept of "stainless steel" includes heat resisting steel exemplified below as well:

(4) Austenitic heat resisting steel

Compositions are stipulated in JIS G 4311 and G 4312, for example, and can be exemplified as follows: SUH 31, SUH 35, SUH 36, SUH 37, SUH 38, SUH 309, SUH 310, SUH 330, SUH 660, SUH 661 and so on.

Description will be given of the reason why the constituting elements and preferable ranges in content thereof are defined in this invention of the present invention constituted as austenite containing stainless:

(1) The Ti content being defined such that $W_{Ti}+0.52\ W_{Zr}=0.03$ to 3.5 mass %, wherein $W_{Ti}$ and $W_{Zr}$ denote respective contents in mass % of Ti and Z In the austenite containing stainless steel as this invention, when a value of $W_{Ti}+0.52\ W_{Zr}$ is lower than 0.03 mass %, the (Ti,Zr) based compound is insufficiently formed in amount, thereby disabling the effect of improving machinability to be satisfactorily exerted. On the other hand, when in excess of the value, machinability is reduced on the contrary. For this reason, the value of $W_{Ti}+0.52\ W_{Zr}$ is required to be suppressed to 3.5 mass % or lower.

(2) One or more of S and Se in the respective ranges of 0.01 to 1.0 mass % for S and 0.01 to 0.8 mass % for Se S and Se are elements for useful in improving machinability. By adding S and Se into an alloy, in an alloy structure, formed is a compound useful for improving machinability (for example, a (Ti, Zr) based compound expressed in the form of a composition formula $(Ti, Zr)_4(S, Se)_2C_2$). Therefore, contents of S and Se are specified 0.01 mass % as the lower limit. When the contents are excessively large, there arises a chance to cause a problem of deteriorating hot workability and therefore, there have to be the upper limits: It is preferable that a S content is set to 1 mass % and a Se content is set to 0.8 mass % as the respective upper limits. Further, S and Se are both desirably added into an alloy in a necessary and sufficient amount in order to form a compound improving machinability of the alloy, such as the above described (Ti,Zr) based compound, and from this viewpoint, a total content in mass % of S and Se is preferably set to a value higher than two times a C content in mass %. An excessive addition of S results in deterioration of the out-gas resistivity.

(3) 0.021 to 0.4 mass % C

C is an important element forming a compound improving machinability. When a content thereof is lower than 0.021 mass %, however, an effect exerting sufficient machinability can not be imparted to the alloy, while when in excess of 0.4 mass %, much of a single carbide not effective for improving machinability is formed. Addition of C is preferably set in the range of 0.021to 0.1mass %, where in it is preferable that addition of C is adjusted so properly that the effect of imparting machinability on the alloy is optimized depending on an amount of a constituting element of a compound improving machinability such as a (Ti,Zr) based compound.

(4) 2 to 50 mass % Ni

Figure 3:
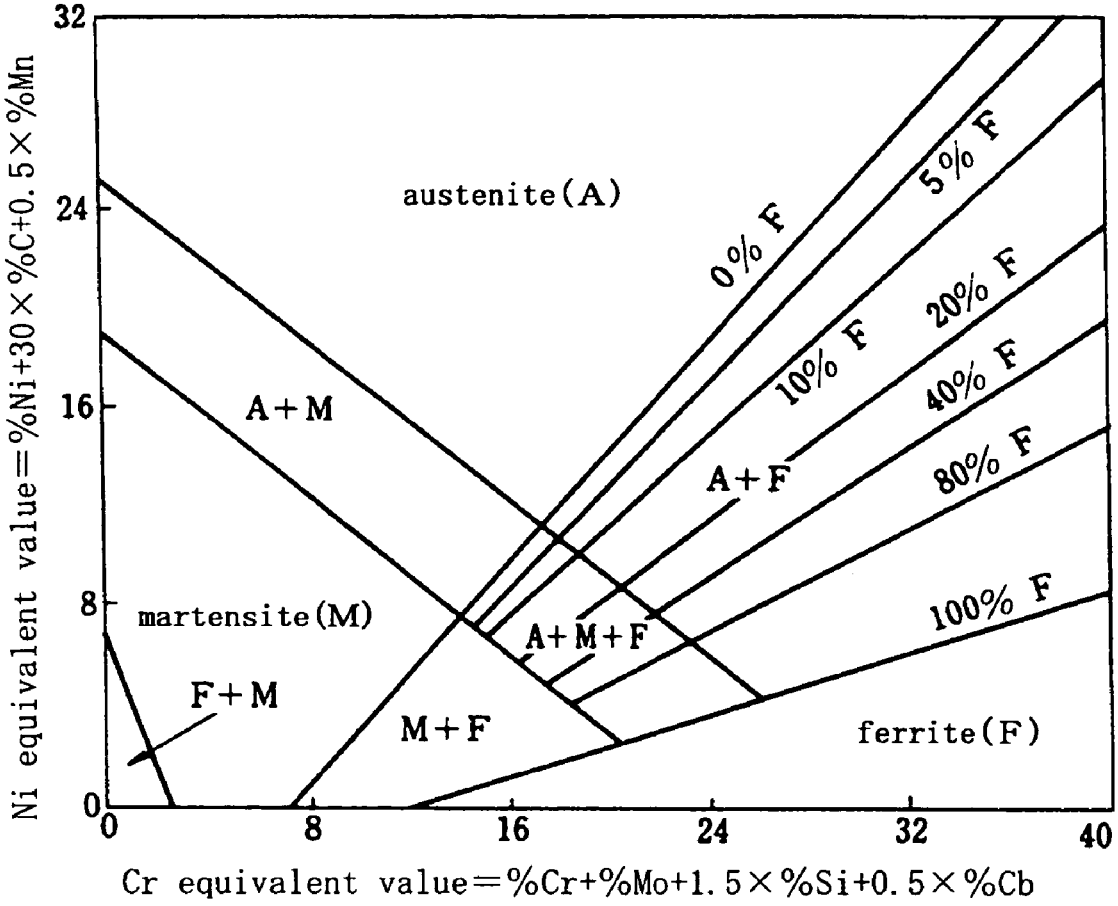
FIG. 3 is a graph showing an example of Schaeffler diagram.

Ni is necessary to be added to stainless steel in a content of at least 2 mass % in order to stabilize an austenitic phase in the stainless steel. Moreover, while Ni has many chances to be added into the matrix since Ni is useful for improving corrosion resistivity in an environment of a reducing acid, it is preferable to add at 2 mass % or higher in content from the viewpoint of improvement on corrosion resistivity. Moreover, when non-magnetism is desired, a necessary amount of Ni is required to be added so as to stabilize an austenitic phase more and thereby obtain an alloy as austenite containing stainless steel, considering connection with contents of other elements such as Cr and Mo. In this case, a Schoeffler diagram shown in FIG. 3 can be utilized for determination of the Ni content. An austenite forming element and a ferrite forming element are converted to equivalents of Ni and Cr amounts and a relationship between the equivalents and the structure is shown in FIG. 3 (see Revised $5^{th}$ version Kinzoku Binran (Metal Hand Book) published by Maruzen in 1990, p. 578). However, it is required to obtain a necessary amount of Ni in consideration of exclusion of an amount in Ti and/or Zr compound from constituting elements of the matrix. Since not only does excessive addition of Ni result in cost-up, but specific characteristics as stainless steel are also degraded, a Ni content is limited to 50 mass % or lower.

(5) 12 to 50 mass % Cr

Cr is an indispensable element for ensuring corrosion resistivity of stainless steel. Hence, Cr is added in a content equal to 12 mass % or higher. When a Cr content is lower than 12 mass %, corrosion resistivity as stainless steel cannot be ensured due to intergranular corrosion caused by increased sensitivity at grain boundaries. On the other hand, when added in excess, there arises a risk that not only is hot workability degraded, but toughness is also reduced due to formation of a compound such as CrS. Furthermore, a problem occurs since high temperature embrittlement becomes conspicuous. For this reason, a Cr content is preferably set in the range of 12 to 50 mass % and performances specific to stainless steel are, in a case, degraded outside the range in content of Cr. Desirably, a Cr content is set in the range of 15 to 30 mass % and more desirably in the range of 17 to 25 mass %.

(6) 5 to 85.926 mass % Fe

Fe is an indispensable component for constituting stainless steel. Therefore, a Fe content is at 5 mass % or higher. When an Fe content is lower than 5 mass %, the Fe content is not preferable since no strength specific to stainless steel can be obtained. That an Fe content exceeds 85.95 mass % is impossible in connection with required contents of other components. Consequently, an Fe content is in the range of 5 to 85.926 mass %. An Fe content is desirably set in the range of 15 to 75 mass % and more desirably in the range of 40 to 65 mass %.

(7) 0.021 to 0.4 mass % C

C is an indispensable component for improvement on machinability and added in a content of 0.021 mass % or higher. With C being included in the matrix, a (Ti,Zr) based compound is formed, and formation of the compound is considered to improves machinability of stainless steel. When a C content is lower than 0.021 mass %, formation of the (Ti,Zr) based compound is insufficient and the effect of improving machinability is not sufficiently attainable. On the other hand, when the content exceeds 0.4 mass %, a carbide not useful for improvement on machinability is excessively formed and therefore, machinability is deteriorated on the contrary. It is considered that residual C not included, as a constituting element, in the (Ti,Zr) based compound contributing to improvement on machinability is dissolved in the matrix phase of stainless steel in a solid state and the residual C in solid solution gives birth to an effect of increasing a hardness of the stainless steel as well. Therefore, a C content is preferably set in a proper manner taking into consideration not only that C is added such that a machinability improvement effect is exerted in best conditions according to an amount of constituting elements of a compound improving machinability, such as the (Ti,Zr) based compound, but also the effect of improving hardness exerted by the residual C dissolved in a solid solution state in the matrix phase. In consideration of the above described circumferences, a C content is desirably in the range of 0.03 to 0.3 mass % and more desirably in the range of 0.05 to 0.25 mass %.

Also in this invention, the S content is desirably determined such that a value of $W_S/(W_{Ti}+0.52W_{Zr})$ is 0.45 or less, or alternatively a value of $W_S/W_C$ is 0.4 or less and $W_S/(W_{Ti}+0.5^2W_{Zr})$ is 0.45 or less. With such a range of components adopted, the out-gas resistivity of the matrix metal phase of stainless steel can be improved.

In a free cutting alloy of the present invention constituted as austenite containing stainless steel, a composition may have the following components and contents there of in order to achieve better characteristics. That is, the composition can be 4 mass % or lower Si; 4 mass % or lower Mn; 4 mass % or lower Cu; and 4 mass % or lower Co. Description will be given of the reason why the composition has the elements and contents thereof as follows:

(8) 4 mass % or lower Si

Si can be added as a deoxidizing agent for steel. However, when a content of Si is excessive high, not only is a hardness after solid solution heat treatment disadvantageously high, which in turn leads to poor cold workability, but an increased amount of a δ-ferrite phase is formed, thereby deteriorating hot workability of the steel. Hence, the upper limit of Si in content is set to 4 mass %. Especially, when cold workability and hot workability are both regarded as important characteristics, a Si content is desirably set to 1 mass % or lower and more desirably to 0.5 mass % or lower.

(9) 4 mass % or lower Mn

Mn not only acts as a deoxidizing agent of the steel, but also exerts an effect to suppress formation of a δ-ferrite phase. Furthermore, Mn has an effect to stabilize an austenitic phase. Since Mn forms a compound useful for increase in machinability in co-existence with S and Se, Mn may added to the matrix when machinability is regarded as an important characteristic. When an effect of improving machinability is expected to be conspicuous, a Mn content is preferably set to 0.6 mass % or higher. When Mn is added, MnS is formed with ease. However, since MnS not only degrades corrosion resistivity to a great extent, but also reduces cold workability, formation of MnS is unwelcome. Therefore, the Mn content is set to 4 mass % or lower. Especially, when corrosion resistivity and cold workability are both regarded as important characteristics, the Mn content is desirably set to 1 mass % or lower and more desirably to 0.5 mass % or lower.

(10) 4 mass % or lower Cu

Cu is not only useful for increase in corrosion resistivity, particularly for improving corrosion resistivity in an environment of a reducing acid, but also reduces work hardnability and improves moldability. Moreover, since a heat treatment or the like processing can improve an antibacterial property, Cu may added if necessary. However, when Cu is excessively added, hot workability is degraded and therefore, a Cu content is preferably set to 4 mass % or lower. Especially, when hot workability is regarded as an important characteristic, the Cu content is more desirably set to 1 mass % or lower.

(11) Co equal to 4 mass % or lower Co

Co is an element not only useful for improving corrosion resistivity, particularly in an environment of a reducing acid, but to exert an effect of ensuring non-magnetism and therefore, may added to the matrix if necessary. It is preferable to add in content of 1 mass % or higher in order to obtain more of conspicuousness of the effect. However, when Co is added in excess, not only is hot workability reduced but cost-up occurs on raw material. Hence, a Co content is preferably set to 4 mass % or lower. Especially, when hot workability or cost is taken seriously, the Co content is more desirably suppressed to 3 mass % or lower.

In the invention constituted as austenite containing stainless steel, the stainless steel can contain one or more of Mo and W in the respective ranges of 0.1 to 10 mass % for Mo and 0.1 to 10 mass % for W. Addition of Mo and W. can improve corrosion resistivity due to strengthened passivation and furthermore attain improved hardness due to second hardening. It is preferable to add Mo and W in each content of 0.1 mass % or higher in order to make the effect exerted clearly. On the other hand, when in excess, hot workability is reduced and therefore, the content of Mo and W combined is preferably set to 10 mass % as the upper limit.

In the austenite containing stainless steel described above, contents of other elements are as follows: the stainless steels can contain: 0.05 mass % or lower P; and 0.03 mass % O; and 0.05 mass % or lower N. Moreover, the stainless steels can further contain one or more of Te, Bi and Pb in the respective ranges of 0.005 to 0.1 mass % for Te; 0.01 to 0.2 mass % for Bi; and 0.01 to 0.3 mass % for Pb. Description will be given of the reason why the elements and contents thereof are defined as follows:

(12) 0.05 mass % or lower P

P is segregated at grain boundaries and not only increases intergranular corrosion sensibility but also sometimes reduces toughness. Therefore, a P content is preferably set as low as possible and to 0.05 mass % or lower. Although the P content is more desirably set to 0.03 mass % or lower, reduction in content more than necessary has a chance to be reflected on increased production cost.

(13) 0.03 mass % or lower O

O combines with Ti or Zr both of which are constituting elements of a compound useful for improving machinability and forms oxides not useful for improving machinability. Therefore, an O content should be suppressed as low as possible and is set to 0.03 mass % as the upper limit. The O content is desirably set to 0.01 mass % or lower if allowable in consideration of increase in production cost.

(14) 0.05 mass % or lower N

N combines with Ti or Zr both of which are constituting elements of a compound useful for improving machinability and forms nitrides not useful for improving machinability. Therefore, a N content should be suppressed as low as possible and is set to 0.05 mass % as the upper limit. The N content is desirably set to 0.03 mass % or lower and more desirably to 0.01 mass %, if allowable in consideration of increase in production cost.

(15) One or more of Te, Bi and Pb in the respective ranges of 0.005 to 0.1 mass % for Te; 0.01 to 0.2 mass % for Bi; and 0.01 to 0.3 mass % for Pb Since Te, Bi and Pb can further improve machinability, the elements may add if necessary. The lower limits thereof at which the respective effects are exerted to clearness are as follows: 0.005 mass % Te; 0.01 mass % Bi and 0.01 mass % Pb, respectively. On the other hand, since excessive addition reduces hot workability, the upper limits are set as follows: 0.1 mass % Te; 0.2 mass % Bi; and 0.3 mass % Pb.

Furthermore, when a free cutting alloy of the present invention is constituted as stainless steel, the alloy can contain one or more selected from the group consisting of Ca, Mg, B and REM (one or more of metal elements classified as Group 3A in the periodic table of elements) in the range of 0.0005 to 0.01 mass % for one element or as a total content in a case of two or more elements. The elements are useful for improving hot workability of steel. The effect of improving hot workability obtainable by addition of the elements is more conspicuously exerted in the range of 0.0005 mass % or higher for one element or as a total content of more than one elements combined. On the other hand, when the elements are added in excess, the effect is saturated and hot workability is then reduced on the contrary. Therefore, the content of a single element or total content of the elements combined is set to 0.01 mass % as the upper limit. As for REM, since low radioactivity elements are easy to be handled when being mainly used, from this viewpoint, it is useful to use one or more selected from the group consisting of Sc, Y, La, Ce, Pr, Nd, Sm, Eu, Gd, Tb, Dy, Ho, Er, Tm, Yb and Lu. It is desirable to use light rare earth elements, especially La or Ce from the viewpoint of conspicuous exertion of the effect and price. However, there arises no trouble with mixing-in of a trace of radioactive rare earth elements such as Th and U inevitably remaining, without being excluded, in a process to separate rare earth elements. Further, from the viewpoint of reduction in raw material cost, there can be used not-separated rare earth elements such as mish metal and didymium.

A free cutting alloy of the present invention constituted as stainless steel can contain one or more selected from the group consisting of Nb, V, Ta and Hf in each range of 0.01 to 0.5 mass %. Since Nb, V, Ta and Hf has an effect of forming carbo-nitrides to miniaturize crystalline particles of steel and increase toughness. Hence, the elements can add in each content up to 0.5 mass % and desirably contain 0.01 mass % or higher in the range.

A free cutting alloy of the present invention constituted as the above described stainless steel can contain 0.035 mass % or lower S in $W_{SO}$ value, wherein $W_{SO}$ is defined as a value obtained in a procedure as follows: An alloy test piece is prepared so as to have the shape of a rectangular prism in size of 15 mm in length, 25 mm in width and 3 mm in thickness with the entire surface being polished with No. 400 emery paper. A silver foil in size of 10 mm in length, 5 mm in width and 0.1 mm in thickness with a purity of 99.9% or higher as a S getter and 0.5 cc of pure water are sealed in a vessel of an inner volume of 250 cc together with the test piece and a temperature in the vessel is raised to 85° C. and said temperature is then kept there for 20 hr; and thereafter, a S content $W_{SO}$ in mass % in the silver foil piece is analyzed.

A (Ti, Zr) based compound being a feature of the present invention is formed and in the course of the formation, added S is included in the stainless steel as a constituting element of the (Ti, Zr) based compound. As a result, a S amount present in the matrix metal phase (Fe based matrix phase) in a dispersed state decreases and therefore, a S amount released into the air from the stainless steel also decreases. Consequently, an out-gas resistivity of the stainless steel can also be improved by formation of the (Ti, Zr) based compound.

In this case, when the out-gas resistivity test is performed, a S component released from the test piece as a sulfur containing gas is forced to be absorbed in the silver foil as a getter and a sulfur content $W_{SO}$, in the silver foil is measured to quantitatively determine the out-gas resistivity of a material. A S content in the stainless steel is defined using the $W_{SO}$ value and set to 0.035 mass % or lower in $W_{SO}$. Stainless steel of the present invention controlled so as to be 0.035 mass % or lower in $W_{SO}$ is hard to cause sulfur contamination in the peripheral parts when exposed to the air since a S component released form the stainless steel into the air is very small and thereby the stainless steel can be preferably used as parts of industrial equipment requiring the out-gas resistivity.

The following paragraphs will describe the metal component of the present invention referring to the attached drawings.

Because the austenitic free cutting alloy has a desirable machinability, it is made possible to obtain a non-magnetic metal component excellent in corrosion resistance through cutting and making it into a desired geometry. FIG. 1 shows a screw as an example of the metal component.

Figure 2:
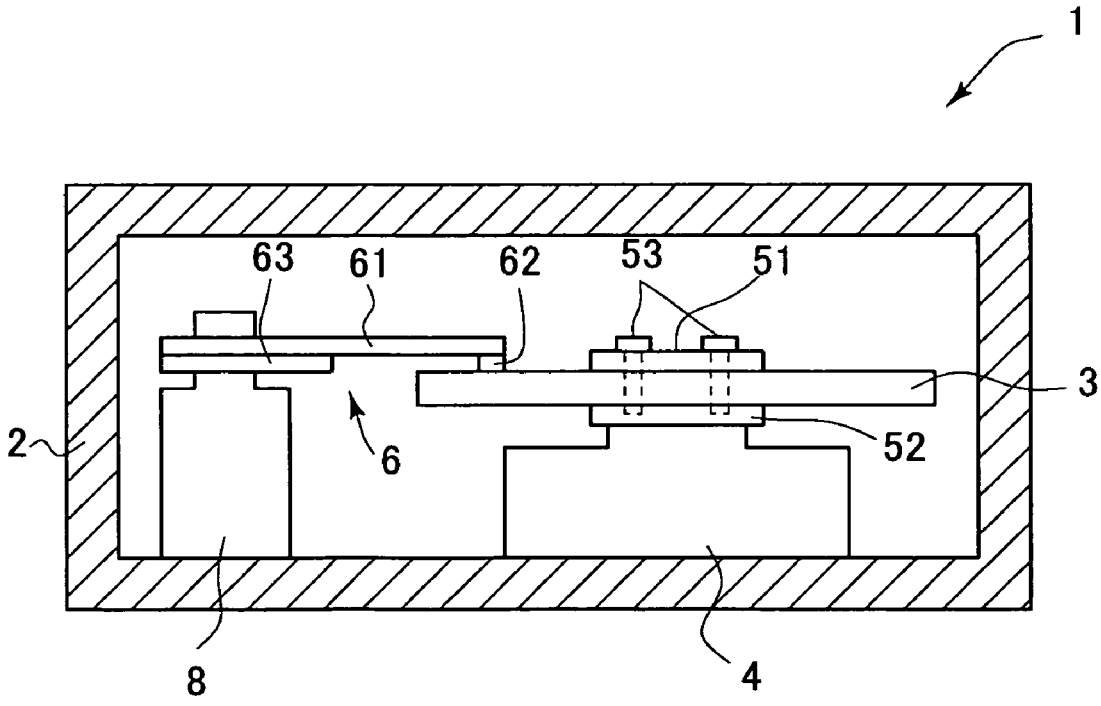
FIG. 2 shows an outline of a sectional structure of a hard disk drive.

Because the metal component of the present invention is non-magnetic, it is preferably used as components composing instruments such as a hard disk drive and so forth. FIG. 2 shows an outline of a sectional structure of the hard disk drive.

The hard disk drive 1 has, inside an enclosure 2, a slider 62 for holding a magnetic head, a head supporting mechanism 6 for supporting the slider 62, an actuator 8 for tracking the magnetic head as being mediated by the head supporting mechanism 6, and a disk drive motor 4 for effecting rotational driving of a disk 3. The head supporting mechanism 6 has an arm 63 and a suspension 61.

The disk drive motor 4 is typically composed of a spindle motor, and allows the disk 3 to rotate at a predetermined speed. The disk 3 is fixed to the disk drive motor 4 using a clamp 51 and a screw 53, while being spaced by a spacer 52.

The actuator 8 moves the slider 62, having the magnetic head held thereon, across the surface of the disk 3 in the radial direction so that the magnetic head can access a predetermined data track on the disk 3. The actuator 8 is typically composed of a linear or rotary voice coil motor.

The slider 62 having the magnetic head held thereon is typically an air bearing slider. Thus-configured slider 62 is brought into contact with the surface of the disk 3 in the start/stop operation of the hard disk drive 1. In the information recording/reproduction operation of the hard disk drive 1, the slider 62 is kept on the surface of the disk 3 with the aid of an air bearing formed between the rotating disk 3 and the slider 62. The magnetic head held by the slider 62 plays a part in read/write operation of information to and from the disk 3.

The metal component of the present invention herein is applicable to any portion of the hard disk drive 1 not directly contributable to read/write operation of information, where examples of the portion include the clamp 51, spacer 52, screw 53 and so forth. It is also applicable to a rotation axis portion of the disk drive motor 4 and a revolving portion of the actuator 8, although not shown.

EXAMPLE

Austenite Containing Stainless Steel

An experiment was performed on a free cutting alloy of the present invention constituted as austenite containing stainless steel (an inventive steel). 50 kg blocks of compositions in mass % shown in Table 1 were molten in a high frequency induction furnace to form ingots. The ingots were heated at a temperature in the range from 1050 to 1100° C. and hot forging was applied on the ingot at the same temperature to be formed into rods each having a circular section, of a diameter of 20 mm. Specimens Nos. 1 to 18 and 22 to 26 are steel corresponding to inventive steels and specimens Nos. 19 to 21 and 27 to 29 are of comparative steels. The specimen No. 19 corresponds to SUS 304, the specimen No. 20 to SUS 303, the specimen No. 27 to SUS 329J4L. Among them, the specimens Nos. 1 to 21 are kinds of steel for use in application of a non-magnetism and the specimens Nos. 22 to 29 are kinds of steel for use in application other than non-magnetism. Among them, the specimens Nos. 1 to 24 and 27 were heated at 1050° C. for 1 hr and thereafter water-cooled, while the other kinds of steel were heated at 750° C. for 1 hr and thereafter water-cooled. Thereafter, both group of kinds of steel were further heated at 650° C. for 2 hr and thereafter water-cooled, followed by tests. All the test pieces of inventive steels obtained each had a main phase in which at least an austenitic phase was formed. Main phases of inventive steels are shown in Table 1, wherein A denotes an austenitic phase, B a ferritic phase and C a martensitic phase.

Figure 4A:
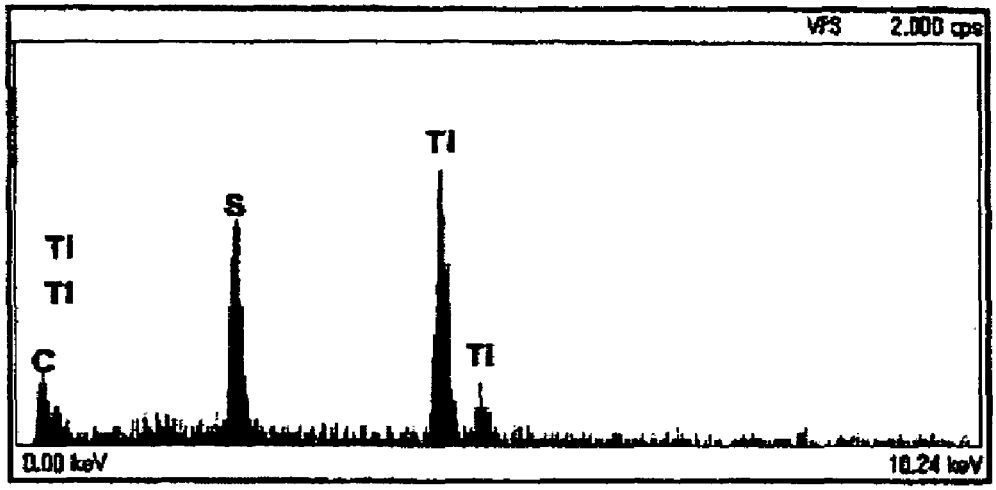
FIGS. 4A and 4B are graphs showing EDX analytical results of an inventive steel specimen No.2 in experiment of Example.
Figure 4B:
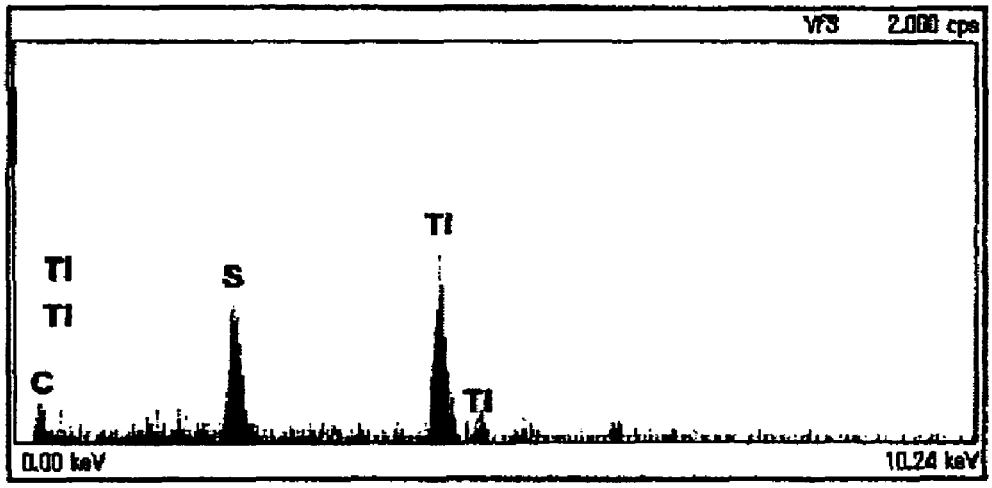
Figure 5:
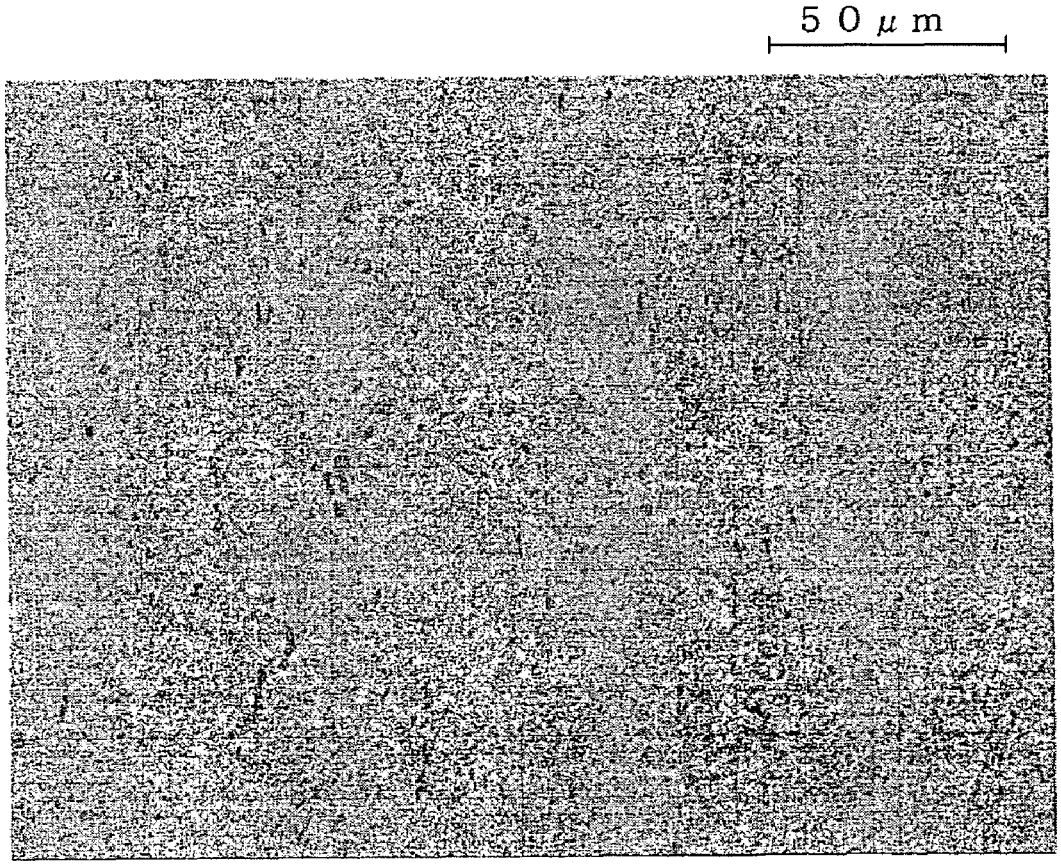
FIG. 5 is an optical microphotograph of the inventive steel No.2 in Example.

While main inclusions of the inventive steel of the present invention was of $(Ti,Zr)_4(S,Se)_2C_2$, other inclusions such as (Ti,Zr)S and $(Ti,Zr)S_3$ are locally recognized. Further, in specimens Nos. 9, 10 and 13 high in a Mn content and the like, (Mn,Cr) S was recognized, though in a small amount. An identification method for inclusions was performed in the following way: A test piece in a proper amount was sampled from each of the rods. A metal matrix portion of the test piece was dissolved by electrolysis using a methanol solution including tetramethylammonium chloride and acetylaceton at 10% as a electrolytic solution. The electrolytic solution after the electrolysis was subjected to filtration and compounds not dissolved in steel were extracted from the filtrate. The extract was dried and subjected to chemical analysis by an X-ray diffraction method with a diffractometer. A compound was identified based on peaks of a diffraction chart. A composition of a compound particle in the steel structure was separately analyzed by EMA and a compound with a composition corresponding to a compound observed by X-ray diffraction was confirmed based on formation from two dimensional mapping results. FIGS. 4A and 4B show EDX analytical results of inclusions in the inventive steel specimen No.2 and from the results, formation of (Ti,Zr) based compound can be recognized. Further, FIG. 5 shows an optical microphotograph of the inventive steels specimen Nos. 2 and 13 shot under a magnification of 400×.

The following experiments were performed on the above described test pieces:

1) Hot Workability Test

Evaluation of hot workability was effected based on visual observation of whether or not defects such as cracks occur in hot forging. (○) indicates that substantially no defect occurred in hot forging, (X) indicates that large scale cracks were recognized in hot forging and Δ indicates that small cracks occurred in hot forging.

2) Evaluation of Machinability

Evaluation of machinability was collectively effected based on cutting resistance in machining, finished surface roughness and chip shapes. A cutting tool made of cermet was used to perform machining under a dry condition at a circumferential speed of 120 m/min, a depth of cutting per revolution of 0.1 mm and a feed rate per revolution of 0.05 mm. A cutting resistance in N as a unit was determined by measuring a cutting force generating in the machining. The finished surface roughness was measured by a method stipulated in JIS B 0601 and a value thereof was an arithmetic average roughness (in in μm Ra) on a test piece surface after the machining. Moreover, chip shapes were visually observed and when friability was good, the result is indicated by (G) and when friability is bad and all chips are not separated but partly connected, the result is indicated by (B).

3) Evaluation of Out-gas Resistivity

Evaluation of out-gas resistivity was performed by determining an amount of released S. To be concrete, test pieces in use each had the shape of a rectangular prism of 15 mm in length, 25 mm in width and 3 mm in thickness and the entire surface of each were polished with an emery paper. A test piece was placed in a sealed vessel having an inner volume of 250 cc together with a silver foil having a size of 10 mm in length, 5 mm in width and 0.1 mm in thickness and 0.5cc of pure water, and a temperature in the vessel was maintained at 85° C. for 20 hr. A S content $W_{SO}$ in the silver foil after the process for the test was measured by a combustion type infrared absorbing analysis method.

4) Cold Workability Test

Evaluation of cold workability was performed by measuring a threshold compressive stain in a compression test on specimens Nos. 1 to 5 and 13. Test pieces for compression each had the shape of a cylinder of 15 mm in diameter and 22.5 mm in height and each piece was compressed by a 600 t oil hydraulic press to obtain a threshold compressive strain, wherein the threshold compressive strain is defined as ln (HO/H) or a natural logarithm of HO/H, HO being an initial height of the test piece and H being a threshold height which is a maximum height at which no cracking has occurred.

5) Evaluation of Corrosion Resistivity

Evaluation of corrosion resistivity was performed by a salt spray test. Test pieces each were prepared so to have the shape of a cylinder of 10 mm in diameter and 50 mm in height. The entire surface of each test piece was polished with #400 emery paper and cleaned. A test piece was exposed to a fog atmosphere of 5 mass % NaCl aqueous solution at 35° C. for 96 hr. Final evaluation was visually performed with the naked eye. As a result, the inventive steel of the present invention was confirmed to maintain good corrosion resistivity. The results obtained are shown in Table 2.

It is found from Table 2 that a free cutting alloy constituted as austenite containing stainless steel of the present invention is comparable with conventional stainless steel in hot workability, cold workability and corrosion resistivity and moreover, is improved in machinability compared with conventional stainless steel. Further, it is found that when comparing with comparative steel of the specimen No. 19, inventive steels of the specimens Nos. 1 to 18 are improved in machinability. Further it is found that when comparing with comparative steel specimen No. 20, the specimens Nos. 1 to 18 are smaller in $W_{SO}$ and excellent in out-gas resistivity. Further, when comparing with comparative steel specimens Nos. 27 to 29, it is found that inventive steel Nos. 22 to 26 are improved on machinability. That is, the inventive steel is comparable with the comparative steel in corrosion resistivity and hot workability and in addition, improved on machinability and out-gas resistivity.

The prior art publication, i.e., JP60-155653 ('653) seems to disclose alloy composition having composition overlapping for several elements. Table 3 presents the austenite iron containing alloy of this invention in contrast to the publication. However, in the alloy composition of '653, the total content of S and Se is lower than C, but in the austenite iron containing alloy of this invention, the total content of S and Se is higher than the content of C. This is intended to enhance the machinability by sufficiently forming (Ti, Zr) based compound. Meanwhile, since the machinability also depends on the matrix composition (the composition of the remaining components excluding the components relating to the (Ti, Zr) based compound such as Ti, Zr, C, S, Se, Te), it is important to compare the effects of forming components of (Ti, Zr) based compound while the matrix composition is kept almost the same, from the viewpoint of checking the effects.

The results, alternately exhibiting the results of alloys (corresponding to the austenite iron containing alloy of this invention) having the total content of S and Se higher than the content of C, in various matrix compositions (Table 1 attached to the specification: 1 to 18), and the results of reference alloys having the total content of S and Se lower than the content of C, in the nearly same matrix compositions are presented in Tables 4 and 5. In all matrix compositions, the alloys of the austenite iron containing alloy of this invention having the total content of S and Se higher than the content of C are substantially lowered in the cutting resistance as compared with the reference alloys, and are enhanced in machinability.

Thus, the austenite iron containing alloy of this invention achieves, in a composition range more limited than in '653, evident and unpredictable effects not disclosed in the publication.

TABLE 1

| | | C | Ni | Cr | Ti | Zr | S | Se | Si | Mn | P | O | N | note | Ti + 0.52Zr | main phase |
|---|---|---|---|---|---|---|---|---|---|---|---|---|---|---|---|---|
| inventive steel | 1 | 0.075 | 9.8 | 18.8 | 0.61 | | 0.21 | | 0.19 | 0.28 | 0.025 | 0.003 | 0.007 | | 0.61 | A |
| | 2 | 0.118 | 12.2 | 20.5 | 0.96 | | 0.32 | | 0.28 | 0.39 | 0.013 | 0.007 | 0.004 | 0.8Cu | 0.96 | |
| | 3 | 0.175 | 11.9 | 19.4 | 1.31 | | 0.44 | | 0.15 | 0.57 | 0.018 | 0.003 | 0.007 | | 1.31 | |
| | 4 | 0.262 | 8.5 | 18.1 | 2.13 | | 0.68 | | 0.31 | 0.32 | 0.008 | 0.003 | 0.009 | | 2.13 | |
| | 5 | 0.118 | 7.9 | 17.8 | 0.98 | | 0.30 | | 0.31 | 0.42 | 0.019 | 0.003 | 0.008 | 1.3Mo | 0.98 | |
| | 6 | 0.171 | 10.4 | 17.9 | 1.28 | | 0.45 | | 0.33 | 0.12 | 0.033 | 0.004 | 0.011 | 0.4Cu, 0.4Mo | 1.28 | |
| | 7 | 0.121 | 8.7 | 17.8 | 1.02 | | 0.31 | | 0.21 | 0.30 | 0.028 | 0.004 | 0.014 | 2.8Cu | 1.02 | |
| | 8 | 0.169 | 19.2 | 24.2 | 1.05 | 0.42 | 0.28 | | 0.61 | 0.18 | 0.042 | 0.001 | 0.019 | | 1.27 | |
| | 9 | 0.062 | 18.6 | 24.5 | 0.55 | 0.24 | 0.19 | | 0.32 | 1.68 | 0.007 | 0.002 | 0.024 | 0.4Cu, 5.8Mo, 0.0029B | 0.67 | |
| | 10 | 0.122 | 35.9 | 30.2 | 1.01 | | 0.32 | | 0.29 | 1.23 | 0.005 | 0.005 | 0.007 | 1.2Co, 0.0018Ca | 1.01 | |
| | 11 | 0.265 | 12.4 | 17.8 | 2.09 | | 0.57 | 0.22 | 0.49 | 0.38 | 0.029 | 0.004 | 0.012 | 2.2Mo, 0.13Pb, 0.0015Mg | 2.09 | |
| | 12 | 0.048 | 41.9 | 15.6 | 0.52 | 0.24 | 0.18 | 0.07 | 0.32 | 0.37 | 0.015 | 0.013 | 0.039 | 5.2Mo, 4.7W, 0.0031REM | 0.64 | |
| | 13 | 0.141 | 20.4 | 24.2 | 1.14 | | 0.38 | 0.06 | 0.72 | 2.44 | 0.002 | 0.002 | 0.004 | 0.08Bi, 0.15Nb | 1.14 | |
| | 14 | 0.071 | 15.2 | 22.9 | 0.51 | | 0.33 | | 0.08 | 0.88 | 0.019 | 0.005 | 0.009 | 1.9W, 0.03Te, 0.0031B | 0.51 | |
| | 15 | 0.032 | 10.9 | 20.2 | 0.18 | | 0.07 | | 0.61 | 0.34 | 0.011 | 0.002 | 0.009 | 0.21Pb, 0.14V | 0.18 | |
| | 16 | 0.092 | 15.3 | 19.1 | 0.88 | | 0.34 | | 2.17 | 0.21 | 0.028 | 0.004 | 0.012 | 0.0022Ca, 0.22Ta | 0.88 | |
| | 17 | 0.155 | 7.9 | 17.2 | 1.11 | | 0.41 | | 0.04 | 0.19 | 0.011 | 0.002 | 0.021 | 1.8Cu, 0.17Hf | 1.11 | |
| | 18 | 0.089 | 6.2 | 17.1 | 0.59 | | 0.19 | | 0.32 | 0.63 | 0.019 | 0.002 | 0.012 | 0.25Pb | 0.59 | |
| comparative steel | 19 | 0.05 | 8.1 | 18.2 | | | 0.01 | | 0.42 | 1.33 | 0.028 | 0.008 | 0.025 | | 0.00 | |
| | 20 | 0.03 | 8.6 | 18.5 | | | 0.33 | | 0.29 | 1.93 | 0.018 | 0.012 | 0.033 | | 0.00 | |
| | 21 | 0.03 | 12.3 | 17.8 | | | 0.33 | | 0.45 | 0.22 | 0.018 | 0.007 | 0.018 | 2.1Mo | 0.00 | |
| | 22 | 0.021 | 8.2 | 25.8 | 0.15 | | 0.05 | | 0.41 | 0.50 | 0.025 | 0.004 | 0.004 | 3.2Mo, 1.1W, 0.0012Mg | 0.15 | F + A |
| inventive steel | 23 | 0.024 | 4.2 | 22.8 | 0.17 | | 0.06 | | 0.32 | 0.41 | 0.016 | 0.003 | 0.009 | 2.2Mo, 0.0011Ca | 0.17 | |
| | 24 | 0.042 | 4.2 | 16.2 | 0.22 | | 0.08 | | 0.25 | 0.93 | 0.022 | 0.005 | 0.012 | 3.1Cu | 0.22 | M + A |
| | 25 | 0.111 | 2.11 | 16.4 | 0.51 | | 0.18 | | 0.33 | 0.54 | 0.016 | 0.006 | 0.009 | | 0.51 | |
| | 26 | 0.055 | 5.33 | 15.8 | 0.52 | | 0.15 | | 0.27 | 0.64 | 0.025 | 0.005 | 0.006 | | 0.52 | |
| comparative steel | 27 | 0.018 | 7.9 | 25.4 | | | 0.001 | | 0.23 | 0.88 | 0.013 | 0.005 | 0.21 | 2.8Mo | 0.00 | |
| | 28 | 0.06 | 2.02 | 16.3 | | | 0.005 | | 0.61 | 0.29 | 0.019 | 0.009 | 0.013 | | 0.00 | |
| | 29 | 0.03 | 5.03 | 16.2 | | | 0.004 | | 0.31 | 0.78 | 0.023 | 0.007 | 0.007 | | 0.00 | |

TABLE 2

| | | hot workability | cutting resistance | finished surface roughness | chip shape | corrosion resistivity | out-gas resistivity | threshold compressive strain |
|---|---|---|---|---|---|---|---|---|
| inventive steel | 1 | ○ | 33.6 | 2.05 | G | A | 0.008 | 1.9 |
| | 2 | ○ | 31.2 | 1.92 | G | A | 0.017 | 1.9 |
| | 3 | ○ | 30.9 | 1.84 | G | A | 0.025 | 1.8 |
| | 4 | ○ | 25.2 | 1.95 | G | A | 0.024 | 1.7 |
| | 5 | ○ | 31.9 | 1.91 | G | A | 0.019 | 1.9 |
| | 6 | ○ | 29.4 | 1.81 | G | A | 0.004 | 1.8 |
| | 7 | ○ | 29.8 | 1.88 | G | A | 0.015 | 2.0 |
| | 8 | ○ | 32.7 | 1.99 | G | A | 0.009 | |
| | 9 | ○ | 36.2 | 2.21 | G | A | 0.030 | |
| | 10 | ○ | 30.5 | 2.16 | G | A | 0.027 | |
| | 11 | ○ | 24.3 | 1.99 | G | A | 0.021 | |
| | 12 | ○ | 37.6 | 2.13 | G | A | 0.018 | |
| | 13 | ○ | 28.9 | 1.91 | G | A | 0.034 | |
| | 14 | ○ | 29.0 | 1.96 | G | A | 0.029 | |
| | 15 | ○ | 32.6 | 2.02 | G | A | 0.003 | |
| | 16 | ○ | 33.3 | 2.00 | G | A | 0.007 | |
| | 17 | ○ | 31.1 | 1.85 | G | A | 0.011 | |
| | 18 | ○ | 26.8 | 1.90 | G | A | 0.022 | |
| comparative steel | 19 | ○ | 42.5 | 2.46 | B | A | 0.004 | 2.1 |
| | 20 | ○ | 31.5 | 1.95 | G | C | 0.062 | 1.3 |
| | 21 | ○ | 35.2 | 2.02 | G | A | 0.014 | 1.3 |
| | 22 | Δ | 39.7 | 2.35 | G | A | 0.003 | |
| inventive steel | 23 | ○ | 38.0 | 2.22 | G | A | 0.004 | |
| | 24 | ○ | 38.0 | 2.11 | G | A | 0.004 | |
| | 25 | ○ | 36.4 | 2.08 | G | A | 0.014 | |
| | 26 | ○ | 35.9 | 1.95 | G | A | 0.010 | |
| comparative steel | 27 | ○ | 47.2 | 2.88 | B | A | <0.001 | |
| | 28 | ○ | 45.0 | 2.91 | B | A | 0.003 | |
| | 29 | ○ | 45.5 | 2.77 | B | A | 0.003 | |

TABLE 3

| | inventive steel | JP60-155653 |
|---|---|---|
| Ni | 2~50 | 20~30 |
| Cr | 12~50 | 10~20 |
| Fe | 5~86.95 | bal. |
| C | 0.024~0.4 | ~0.15 |
| Ti + 0.52 Zr | 0.03~3.5 | 1.5~3 |

TABLE 3-continued

| | inventive steel | JP60-155653 |
|---|---|---|
| S | 0.01~1 | ~0.015 |
| Se | 0.01~0.8 | — |
| S + Se | more than C[Δ] | less than C(Table 1)[Δ] |

[Δ]the range does not overlap with JP60-155653

TABLE 4

| | | C | Ni | Cr | Ti | Zr | S | Se | Si | Mn | P | 0 | N | note | Ti + 0.52Zr |
|---|---|---|---|---|---|---|---|---|---|---|---|---|---|---|---|
| inventive steel | 1 | 0.075 | 9.8 | 18.8 | 0.61 | | 0.21 | | 0.19 | 0.28 | 0.025 | 0.003 | 0.007 | | 0.61 |
| | 1' | 0.083 | 9.6 | 18.9 | 0.63 | | 0.06 | | 0.22 | 0.31 | 0.026 | 0.005 | 0.006 | | 0.63 |
| | 2 | 0.118 | 12.2 | 20.5 | 0.96 | | 0.32 | | 0.28 | 0.39 | 0.013 | 0.007 | 0.004 | 0.8Cu | 0.96 |
| | 2' | 0.096 | 12.2 | 20.2 | 0.83 | | 0.01 | | 0.22 | 0.32 | 0.021 | 0.006 | 0.005 | 0.8Cu | 0.83 |
| | 4 | 0.262 | 8.5 | 18.1 | 2.13 | | 0.68 | | 0.31 | 0.32 | 0.008 | 0.003 | 0.009 | | 2.13 |
| | 4' | 0.255 | 8.8 | 18.2 | 2.43 | | 0.21 | | 0.35 | 0.35 | 0.012 | 0.005 | 0.006 | | 2.43 |
| | 5 | 0.118 | 7.9 | 17.8 | 0.98 | | 0.30 | | 0.31 | 0.42 | 0.019 | 0.003 | 0.008 | 1.3Mo | 0.98 |
| | 5' | 0.102 | 7.8 | 17.8 | 0.59 | | 0.07 | | 0.30 | 0.41 | 0.019 | 0.004 | 0.006 | 1.3Mo | 0.59 |
| | 7 | 0.121 | 8.7 | 17.8 | 1.02 | | 0.31 | | 0.21 | 0.30 | 0.028 | 0.004 | 0.014 | 2.8Cu | 1.02 |
| | 7' | 0.133 | 9.0 | 18.3 | 0.99 | | 0.13 | | 0.25 | 0.30 | 0.027 | 0.005 | 0.009 | 2.6Cu | 0.99 |
| | 8 | 0.169 | 19.2 | 24.2 | 1.05 | 0.42 | 0.28 | | 0.61 | 0.18 | 0.042 | 0.001 | 0.019 | | 1.27 |
| | 8' | 0.175 | 19.8 | 23.7 | 0.95 | 0.58 | 0.14 | | 0.55 | 0.21 | 0.033 | 0.003 | 0.012 | | 1.25 |
| | 9 | 0.062 | 18.6 | 24.5 | 0.55 | 0.24 | 0.19 | | 0.32 | 1.68 | 0.007 | 0.002 | 0.024 | 0.4Cu, 5.8Mo, 0.0029B | 0.67 |
| | 9' | 0.056 | 18.6 | 24.3 | 0.51 | 0.18 | 0.03 | | 0.32 | 1.42 | 0.011 | 0.003 | 0.021 | 0.6Cu, 5.7Mo, 0.0012B | 0.60 |
| | 10 | 0.122 | 35.9 | 30.2 | 1.01 | | 0.32 | | 0.29 | 1.23 | 0.005 | 0.005 | 0.007 | 1.2Co, 0.0018Ca | 1.01 |
| | 10' | 0.123 | 34.4 | 28.6 | 0.83 | | 0.09 | | 0.25 | 1.08 | 0.009 | 0.004 | 0.009 | 1.2Co, 0.0032Ca | 0.83 |
| | 15 | 0.032 | 10.9 | 20.2 | 0.18 | | 0.07 | | 0.61 | 0.34 | 0.011 | 0.002 | 0.009 | 0.21Pb, 0.14V | 0.18 |
| | 15' | 0.075 | 10.6 | 20.9 | 0.23 | | 0.05 | | 0.58 | 0.28 | 0.021 | 0.005 | 0.006 | 0.24Pb, 0.12V | 0.23 |
| | 16 | 0.092 | 15.3 | 19.1 | 0.88 | | 0.34 | | 2.17 | 0.21 | 0.028 | 0.004 | 0.012 | 0.0022Ca, 0.22Ta | 0.88 |
| | 16' | 0.103 | 14.2 | 19.5 | 0.82 | | 0.06 | | 1.83 | 0.35 | 0.023 | 0.006 | 0.008 | 0.0015Ca, 0.05Ta | 0.82 |

The dashed sample numbers indicate comparative examples.

TABLE 5

| | | hot workability | cutting resistance | finished surface roughness | chip shape | corrosion resistivity | out-gas resistivity | threshold compressive strain |
|---|---|---|---|---|---|---|---|---|
| inventive steel | 1 | ○ | 33.6 | 2.05 | E | A | 0.008 | 1.9 |
| | 1' | ○ | 41.5 | 3.21 | E | A | 0.004 | 1.5 |
| | 2 | ○ | 31.2 | 1.92 | E | A | 0.017 | 1.9 |
| | 2' | ○ | — | — | — | A | 0.003 | 1.5 |
| | 4 | ○ | 25.2 | 1.95 | E | A | 0.024 | 1.7 |
| | 4' | ○ | — | — | — | A | 0.007 | 1.3 |
| | 5 | ○ | 31.9 | 1.91 | E | A | 0.019 | 1.9 |
| | 5' | ○ | 38.5 | 2.64 | E | A | 0.008 | 1.5 |
| | 7 | ○ | 29.8 | 1.88 | E | A | 0.015 | 2.0 |
| | 7' | ○ | 42.2 | 2.92 | E | A | 0.010 | 1.4 |
| | 8 | ○ | 32.7 | 1.99 | E | A | 0.009 | |
| | 8' | ○ | 40.4 | 3.00 | E | A | 0.004 | |
| | 9 | ○ | 36.2 | 2.21 | E | A | 0.030 | |
| | 9' | ○ | 43.5 | 2.88 | B | A | 0.006 | |
| | 10 | ○ | 30.5 | 2.16 | E | A | 0.027 | |
| | 10' | ○ | 40.2 | 3.11 | E | A | 0.009 | |
| | 15 | ○ | 32.6 | 2.02 | E | A | 0.003 | |
| | 15' | ○ | 35.3 | 2.58 | G | A | 0.004 | |
| | 16 | ○ | 33.3 | 2.00 | E | A | 0.007 | |
| | 16' | ○ | 39.5 | 3.06 | E | A | 0.004 | |

The dashed sample numbers indicate comparative examples.

What is claimed is:

1. A metal component composed of a free cutting alloy, having at least a part of the surface thereof subjected to cutting, wherein the free cutting alloy is constituted as austenite iron containing alloy containing:

2 to 50 mass % Ni; 12 to 50 mass % Cr; 5 to 85.926 mass % Fe; 0.021 to 0.4 mass % C;

one or more of Ti and Zr such that $W_{Ti}$ +0.52 $W_{Zr}$=0.03 to 3.5 mass %, wherein $W_{Ti}$ and $W_{Zr}$ denote respective contents in mass % of Ti and Zr; and one or more of S and Se in the respective ranges of 0.06 to 1 mass % for S and 0.01 to 0.8 mass % for Se so that the total amount of S and Se is more than the C content;

wherein a total content in mass % of Ti and Zr is 1.55 or more times as much as a total content in mass % of S and Se;

wherein a (Ti,Zr) based compound containing one or more of Ti and Zr as a metal element component, C being an indispensable element as a bonding component with the metal element component, and one or more of S, Se and Te is dispersed in a matrix metal phase;

wherein S content is determined such that a value of $W_S/(W_{Ti}+0.52W_{Zr})$ is 0.45 or less, wherein $W_S$ and $W_C$ denote a S content and a C content, respectively.

2. The metal component according to claim 1, the $W_{SO}$ value of which is less than 0.035 mass % when the following test is performed: an alloy test piece is prepared so as to have the shape of a rectangular prism in size of 15 mm in length, 25 mm in width and 3 mm in thickness with the entire surface being polished with No. 400 emery paper; a silver foil in size of 10 mm in length, 5 mm in width and 0.1 mm in thickness with a purity of 99.9% or higher as a S getter and 0.5 cc of pure water are sealed in a vessel of an inner volume of 250 cc together with said test piece; a temperature in said vessel is raised to 85° C. and said temperature is then kept there for 20 hr; and thereafter, a S content $W_{SO}$ in mass % in said silver foil piece is analyzed.

3. The metal component according to claim 1 further containing: 4 mass % or lower Si; 4 mass % or lower Mn; 4 mass % or lower Cu; and 4 mass % or lower Co.

4. The metal component according to claim 1 further containing one or more of Mo and W in the respective ranges of 0.1 to 10 mass % for Mo and 0.1 to 10 mass % for W.

5. The metal component according to claim 1 further containing: 0.05 mass % or lower P; and 0.03 mass % or lower O; and 0.05 mass % or lower N.

6. The metal component according to claim 1 further containing one or more of Te, Bi and Pb in the respective ranges of 0.005 to 0.1 mass % for Te; 0.01 to 0.2 mass % for Bi; and 0.01 to 0.3 mass % for Pb.

7. The metal component according to claim 1 further containing one or more selected from the group consisting of Ca, Mg, B and metal elements classified as Group 3A in the periodic table of elements in the range of 0.0005 to 0.01 mass % for one element or as a total content of more than one elements combined.

8. The metal component according to claim 1 further containing one or more selected from the group consisting of Nb, V, Ta and Hf each of which is in a range of 0.01 to 0.5 mass %.

9. A method of fabricating a metal component comprising a step of subjecting a free cutting alloy to cutting to thereby obtain a metal component having a desired geometry, wherein the free cutting alloy is constituted as austenite iron containing alloy containing:

2 to 50 mass % Ni; 12 to 50 mass % Cr; 5 to 85.926 mass % Fe; 0.021 to 0.4 mass % C.

one or more of Ti and Zr such that $W_{Ti}$+0.52 $W_{ZR}$=0.03 to 3.5 mass %, wherein $W_{Ti}$ and $W_{Zr}$ denote respective contents in mass % of Ti and Zr; and one or more of S and Se in the respective ranges of 0.01 to 1 mass % for S and 0.01 to 0.8 mass % for Se so that the total amount of S and Se is more than the C content;

and wherein a total content in mass % of Ti and Zr is 1.55 or more times as much as a total content in mass % of S and Se;

and wherein a (Ti,Zr) based compound containing one or more of Ti and Zr as a metal element component, C being an indispensable element as a bonding component with the metal element component, and one or more of S, Se, and Te is dispersed in a matrix metal phase.

10. The method of fabricating a metal component according to claim 9 whose S content is determined such that a value of $W_S/(W_{Ti}+0.52W_{Zr})$ is 0.45 or less, wherein $W_S$ and $W_C$ denote a S content and a C content, respectively.

11. The method of fabricating a metal component according to claim 10, the $W_{SO}$ value of which is less than 0.035 mass % when the following test is performed: an alloy test piece is prepared so as to have the shape of a rectangular prism in size of 15 mm in length, 25 mm in width and 3 mm in thickness with the entire surface being polished with No. 400 emery paper; a silver foil in size of 10mm in length, 5 mm in width and 0.1 mm in thickness with a purity of 99.9% or higher as a S getter and 0.5 cc of pure water are sealed in a vessel of an inner volume of 250 cc together with said test piece; a temperature in said vessel is raised to 85° C. and said temperature is then kept there for 20 hr; and thereafter, a S content $W_{SO}$ in mass % in said silver foil piece is analyzed.

12. The method of fabricating a metal component according to claim 9 further containing: 4 mass % or lower Si; 4 mass % or lower Mn; 4 mass % or lower Cu; and 4 mass % or lower Co.

13. The method of fabricating a metal component according to claim 9 further containing one or more of Mo and W in the respective ranges of 0.1 to 10 mass % for Mo and 0.1 to 10 mass % for W.

14. The method of fabricating a metal component according to claim 9 further containing 0.05 mass % or lower P; and 0.03 mass % or lower O; and 0.05 mass % or lower N.

15. The method of fabricating a metal component according to claim 9 further containing one or more of Te, Bi and Pb in the respective ranges of 0.005 to 0.1 mass % for Te; 0.01 to 0.2 mass % for Bi; and 0.01 to 0.3 mass % for Pb.

16. The method of fabricating a metal component according to claim 9 further containing one or more selected from the group consisting of Ca, Mg, B and metal elements classified as Group 3A in the periodic table of elements in the range of 0.0005 to 0.01 mass % for one element or as a total content of more than one elements combined.

17. The method of fabricating a metal component according to claim 9 further containing one or more selected from the group consisting of Nb, V, Ta and Hf each of which is in a range of 0.01 to 0.5 mass %.

* * * * *